United States Patent [19]

Behan, Jr. et al.

[11] 3,999,338

[45] Dec. 28, 1976

[54] ROOF FRAMEWORK EMPLOYING SLOTTED GABLE CONSTRUCTION

[75] Inventors: William L. Behan, Jr., Ladue; Thomas E. DeZern, Sr., St. Louis, both of Mo.

[73] Assignee: Hill-Behan Lumber Company, St. Louis, Mo.

[22] Filed: Sept. 18, 1975

[21] Appl. No.: 614,370

[52] U.S. Cl. ..... 52/92; 52/90; 52/94; 52/639; 52/643

[51] Int. Cl.[2] ..... E04B 7/02

[58] Field of Search ..... 52/79, 93, 94, 643, 52/90, 641, 92, 642, 639; 346/19, 20

[56] References Cited

UNITED STATES PATENTS

| | | | |
|---|---|---|---|
| 506,732 | 10/1893 | Scheidler | 52/639 X |
| 611,309 | 9/1898 | Young | 52/92 |
| 678,728 | 7/1901 | George | 52/92 |
| 841,759 | 1/1907 | Baker | 52/92 |
| 1,421,299 | 6/1922 | Palen | 52/93 |
| 2,332,059 | 10/1943 | Cheshier | 52/643 |
| 2,541,784 | 2/1951 | Shannon | 52/643 X |
| 2,762,084 | 9/1956 | Singer | 52/92 X |
| 3,012,291 | 12/1961 | Rice | 52/90 X |
| 3,137,967 | 6/1964 | Flieth | 46/19 X |
| 3,206,903 | 9/1965 | Johnson | 52/92 |
| 3,293,808 | 12/1966 | Duncan | 52/92 |
| 3,421,270 | 1/1969 | Chaney | 52/639 X |
| 3,668,828 | 6/1972 | Nicholas | 52/92 |
| 3,902,280 | 9/1975 | Spoar et al. | 52/92 |

FOREIGN PATENTS OR APPLICATIONS

| | | | |
|---|---|---|---|
| 1,293,501 | 4/1962 | France | 52/639 |

*Primary Examiner*—Price C. Faw, Jr.
*Assistant Examiner*—Leslie Braun
*Attorney, Agent, or Firm*—Charles B. Haverstock

[57] ABSTRACT

A roofing framework adapted for mounting atop a selected pair of opposite side walls of a building structure said framework including a pair of spaced apart opposed base members, each of said base members having a plurality of upwardly extending column members attached at corresponding locations therealong, and each of said column members including a notched upper end portion. Also included are a plurality of roof supported members respectively bridging the space between the base members and being supported in the notches of correspondingly located column members on the opposed base members, and bracing members connecting selected column members, so that said column members, the roof support members and the bracing members form a connected frame support on which a roof deck can be laid and supported.

10 Claims, 4 Drawing Figures

ROOF FRAMEWORK EMPLOYING SLOTTED GABLE CONSTRUCTION

This invention relates generally to a roof framework construction which may be utilized to provide a wide variety of desired roof shapes and which is particularly adaptable for use in hip-type roof constructions such as are commonly employed on barnlike and other relatively small out-buildings used for storage and other purposes. Although many roof constructions and roof frames are in existence, for the most part the known constructions are relatively complex, are time-consuming and expensive to fabricate, and are difficult to assemble, especially for persons having relatively little skill and training. Also, many of the known constructions include specially manufactured or pre-notched component members which often result in problems during assembly of the roof structure when they do not fit together properly. Additionally, many of the existing roofing constructions and roof frame supports are made as integral parts of entire building constructions, so they often include members which also are components or parts of the side walls of the buildings. Thus, separate construction and assembly of the known roof frameworks apart from the remainder of the building structure is often not possible. This is an important disadvantage of most known roofing constructions because it prevents separately fabricating the roof support members for later assembly at the building site, thus requiring more relatively difficult on-site fabrication and substantially increasing the construction costs.

Indicative of the prior art, the most pertinent roofing constructions known are those disclosed in U.S. Pat. Nos. 678,728; 3,206,903; 611,309; and 841,759. In each of the patented constructions, there is disclosed a roof framework which is part of an entire building construction, and separate fabrication, assembly and installation of a frame for the roof is not possible or contemplated with any of them. Furthermore, as stated, most of the prior art roof frame constructions require special machining, grooving and/or prenotching of selected members which significantly adds to the overall cost of the building; and, like most known roof frame constructions, all of the referenced prior art structures employ a relatively large number of rafter members which extend downwardly from a central ridge pole and in some cases between purlin beams at the pitch angle of the roof. Such rafters in hip-type roofs are especially difficult and time-consuming to make and install.

In its preferred form, the present roofing construction lends itself especially to the construction of attractive and strong, easy to make and install, roofing frameworks that require far fewer structural members than any known construction. Also, because the present construction does not require the prenotching or special machining of any of its component members and does not utilize any rafters as such, it can be fabricated and assembled apart from the work site where assembly line procedures can be used and in less time and cheaper than known frameworks used for the same or similar purposes. Furthermore, it is contemplated to construct the present frameworks using commonly available building materials and fastening means such as 2 × 4 boards and nails, and most of the present frameworks can be fabricated and assembled under factory conditions for easy installation as stated. After fabrication and assembly of the subject frame, a roof deck such as a roof deck made of plywood or other panels and an overlay of shingles or the like can be laid directly thereon either before or after the roof framework is attached to the building side walls.

It is a principal object of the present invention, therefore, to provide a roof frame construction which is simple and inexpensive to construct and is particularly adaptable for use on relatively small buildings such as out-buildings used for storage and other purposes.

Another object is to provide a roof frame construction which does not require rafters.

Another object of the present invention is to provide a roof framework which lends itself to being pre-assembled and prepackaged at a different location than the building site.

Another object of the present invention is to provide a roof construction adaptable for use in prefabricated buildings.

Another object is to provide a roof construction which may be easily modified to produce a wide variety of desired roof shapes.

Another object is to provide a roof construction which is relatively strong and durable.

Another object is to provide a roof construction which does not require specially manufactured, pre-grooved or pre-slotted component parts, and which may be constructed and assembled using commonly available building materials and readily available carpenters' tools.

Another object is to enable preassembly and prepackaging of the major components of a building structure for the do-it-yourself trade.

Still another object is to teach the construction of a roof structure which can be made and assembled by persons having relatively little skill and training.

Yet another object of the present invention is to provide a roof construction that can be assembled relatively easily and quickly and with fewer parts than known constructions.

These and other objects and advantages of the present roof construction will become apparent after considering the following detailed specification which covers preferred embodiments thereof in conjunction with the accompanying drawing, wherein like numerals refer to like parts wherever they occur, and wherein.

Figure 1:
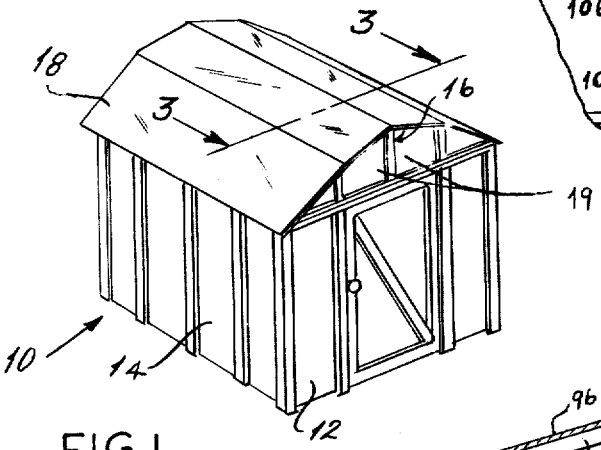
FIG. 1 is a perspective view of a storage shed or the like having a roof framework constructed according to the teachings of the present invention.

Referring to the drawing more particularly by reference numbers, the number 10 in FIG. 1 refers to an entire building structure such as a shed used for storage and other purposes. The building 10 includes two pairs of opposite side walls such as walls 12 and 14 (of which there are two each), and a roofing framework 16 constructed according to the teachings of the present invention and positioned atop the pairs of opposite side walls 12 and 14. Also, the building has a roof deck 18 which is laid upon and supported by the framework 16.

Figure 2:
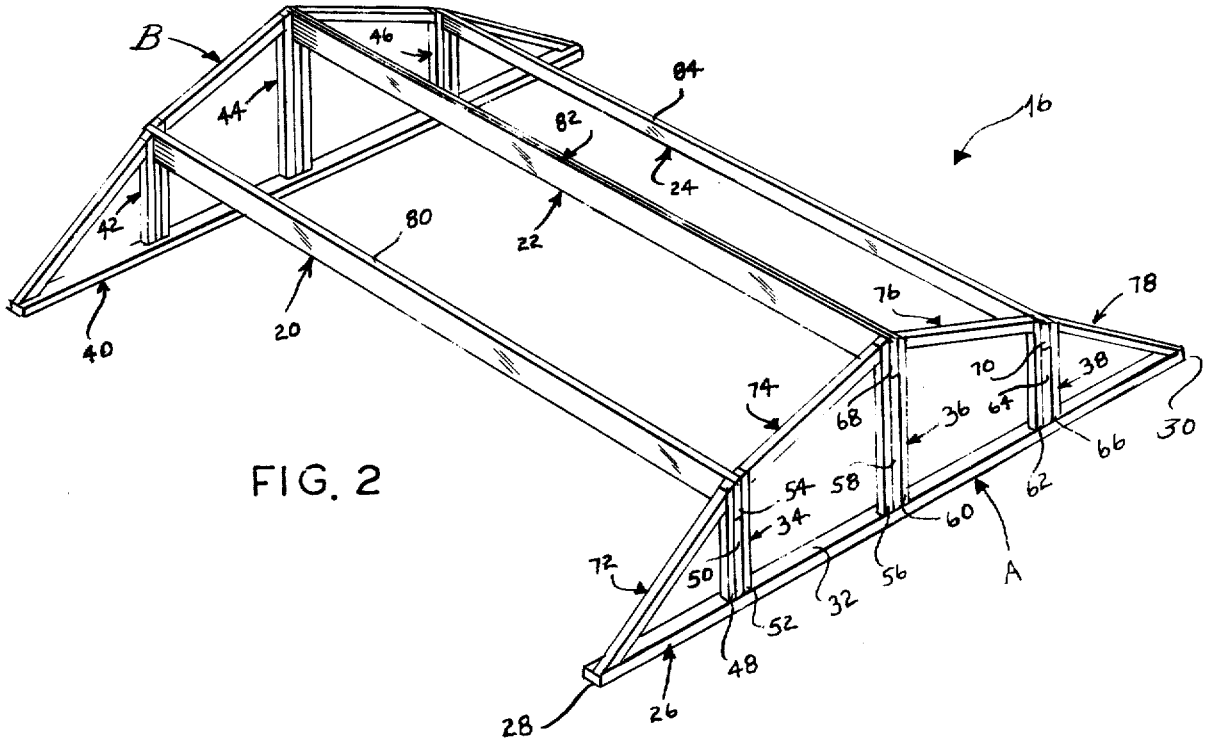
FIG. 2 is an enlarged, skeletal view of the roof frame portion of the shed shown in FIG. 1.

As shown in FIG. 2, the roofing framework 16 in its preferred form has two similarly formed opposite end frame portions or structures, generally indicated by A and B. The frames are preferably pre-assembled under factory conditions, and jigs may be used for this purpose if desired. For easy pre-assembly of the end frames A and B, the frames can be formed on panels such as panel 19 shown in FIG. 1. As shown, the panel 19 has a one-piece construction and is mounted on an inner side of one of the frames, but such panels as the panel 19 can also be formed as several pieces and/or mounted on the outer sides of the frames as well as on the inner sides as shown. After such pre-assembly, it is preferred that the frames first be installed upon the side walls 12 of the building and then connected by members or purlin beams 20, 22 and 24. These preferances are made to reduce the amount of time required for fabrication, assembly and installation of the framework 16 at the job site, and also to obviate any requirement for lifting the entire framework 16 at one time for installation on the side walls. When the end frame structures A and B are installed on the side walls 12, the distance therebetween is approximately the same as that between the opposed side walls 12.

The end frame portion or structure A has an elongated base member or rail 26 with opposite ends 28 and 30 and a top surface 32. Mounted on and extending upwardly from the top surface 32 of the member 26 and at spaced locations therealong are upright column members 34, 36 and 38. Likewise, the end frame or structure B has a base member 40 similar to the member 26, and it also has upright column members 42, 44 and 46 which respectively are located at positions corresponding and opposed to the column members 34, 36 and 38. Any of a wide number of conventional techniques may be used for the mounting of the above-mentioned column members such as by nailing, gluing, riveting, welding or the like, and the technique selected depends upon the material used for fabricating the framework 16. For example, in the illustrated forms of the framework 16, readily available wooden planks or members such as 2 × 4 boards or similar members are used in its construction. Therefore, the technique selected for the mounting would usually be nailing or the like. However, the present construction also lends itself to being made of other materials including steel and plastic, and with these other materials a technique such as gluing, riveting, welding or others may be more appropriate. Further, in the form of the invention shown in FIG. 2, three of the column members are shown extending upwardly from each of the base members 26 and 40, but this number can be increased depending on the roof strength requirements and the shape desired for the roof. In this respect, the number and spacing of the column members is selected to provide structural support for the roof; and, in the construction of relatively small buildings such as out-buildings used for storage and other purposes, only three supports are usually required in each of the end portions A and B. It is apparent, however, that the roof framework 16 is also easily adaptable for use on larger buildings and on structures requiring unusually strong roof constructions, and this can be achieved by adding additional and, if necessary, more closely spaced column members like those shown.

Each of the column members 34, 36, 38, 42, 44 and 46 is provided with a downwardly extending transverse notch or groove in its upper end, and these notches or grooves are formed by the different lengths of the adjacent members used in their construction, although they could be formed by slotting the upper ends of single column members if desired. The notches or grooves receive and support end portions of the purlin beams 20, 22 and 24; and, in the illustrated embodiments, the notches are formed by three adjacent posts or boards including a central board which is shorter than the other two. As shown in FIG. 2, the column member 34 is formed by boards 48, 50 and 52 with the centrally positioned board 50 being shorter than the boards 48 and 52 to form notch 54 in the upper end thereof. The same is also true for the other column members 36, 38, 42, 44 and 46. In the case of the column member 36, the boards are members 56, 58 and 60, and for the column member 38 the boards are members 62, 64 and 66; and, the notches for the columns 36 and 38 are notches 68 and 70, respectively. On the opposite end frame portion B, the column members 42, 44 and 46 are constructed similarly to the column members 34, 36 and 38, respectively, and have notches or grooves in their upper ends which are formed in a like manner. Further, in the preferred forms of the invention, it is important to note that the notches or grooves are formed without requiring any special machining or pre-notching steps. Instead, the notches or grooves are formed by cutting different length boards using readily available building materials and conventional carpenters'to tools. For example, to construct the column members, it is only necessary to cut different length boards such as 2 × 4's to proper lengths and attach them together and to the base members by using nails or the like. This can be done quickly and easily using a saw and hammer and, if desired, a simple jig of some kind. This is an important advantage over the known prior art roof frame constructions which require special machine and other operations at the building site and/or pre-notched members. Such special operations and pre-notched members substantially increase construction and assembly costs and make field construction difficult and time-consuming.

As previously indicated, the present roofing construction is particularly adaptable for use in the construction of hip-type roofs. The drawings illustrate several such constructions which employ different length column members. It is apparent, however, that other roof shapes can also be made by selecting different numbers of column members and different lengths for the columns.

In the constructions shown in the drawing, the frame portion A also has bracing members 72, 74, 76 and 78 which are included to provide lateral support between the columns and to provide additional support for the roof deck. A bracing member such as the bracing member 74 is attached extending between the upper end portions of the column members 34 and 36, and a similar bracing member such as the member 76 extends between the upper ends of the column members 36 and 38. The other bracing members 72 and 78 extend from adjacent to the upper end portions of the column members 34 and 38 to abut the respective opposite end portions of the upper surface 32 of the base member 26. The members 72, 74, 76 and 78 therefore connect the upper ends of adjacent columns to provide lateral bracing therebetween, and help to define the shape of the roof. Also, they provide additional members to which the roof deck 18 is attached. Similar bracing members are provided on the frame portion B.

As mentioned above, the end frame portions A and B are connected together by the purlin beams or roof support members 20, 22 and 24, shown in FIG. 2. More specifically, the roof beams 20 and 24 extend between the respective pairs of opposed column members 34 and 42 and the members 38 and 46, and the opposite ends of the purlin beams are supported in the notches formed in the respective column members between which they extend. In a like manner, the ridge beam or roof support member 22 extends between the column members 36 and 44 and has its opposite end portions supported in the vertical notch 68 and the corresponding notch formed in the column 44. If additional column members are provided on each of the base members, the number of purlin beams will be correspondingly increased. Besides serving to connect the end frame portions A and B, the purlin beams 20, 22 and 24 also provide upwardly facing surfaces 80, 82 and 84 upon which the roof deck 18 is mounted and supported. Further, it is important to note that most of the support for the roof deck 18 is provided by the purlin beams 20, 22 and 24 and to some extent also by the bracing members and the vertical columns. This is to be contrasted with the prior art constructions which have included rafters which when they are used are positioned at spaced locations along the roof and are connected between the ridge pole or beam and the other purlin beams and the tops of the side walls 14. Such rafters are difficult and time-consuming to fabricate and install and add substantially to the cost of constructing a roof assembly because of the labor required at the building site. The present construction because of its design uses no rafters, and this is seen as an important advantage over the roofing constructions known heretofore. Additionally, in the form of the invention shown in FIG. 2, the vertical notches or grooves formed in the upper ends of the column members are formed to correspond with the cross-sectional dimensions of the purlin beams which are to be inserted therein. This is done for reasons of economy and to simplify the construction, as will be discussed.

Figure 3:
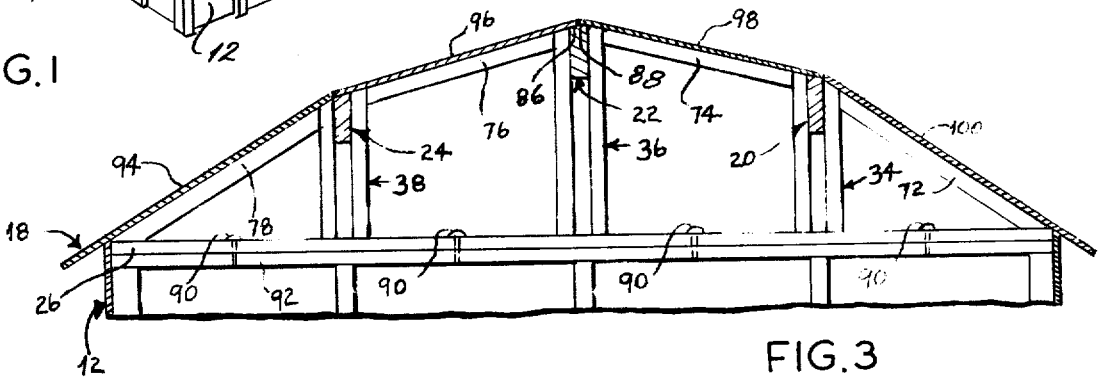
FIG. 3 is an enlarged, cross-sectional view of the roof frame portion of the building shown in FIG. 1 taken substantially along line 3—3 thereof (with an end closure panel removed for purposes of clarity); and, FIG. 4 is a fragmentary, cross-sectional view similar to FIG. 3, but showing a modified form of the present construction.

It is also preferred that some of the structural components of the framework 16 including the upper ends of the column members and the upper surfaces of the purlin beams be cut at an angle to make the surfaces of the frame members A and B to which the roof deck 18 is attached flush with the lower surfaces of the deck. This is preferred to make attaching the roof deck 18 easier and to provide additional support for the deck. Also, this makes for a more vibration free roofing construction. The precise amount of angling of the members will depend upon the desired contour of the roof, and such details can be more easily made under shop conditions than in the field. Also, if the parts are to be beveled as indicated, it should be noted that it will be necessary to form two bevels 86 and 88 on opposite sides of the ridge beam 22, as can be seen in FIG. 3. However, it is not always necessary to this angling, and it is contemplated to use standard unbeveled pieces without changing the nature of the invention.

Several different ways of assembling, installing and constructing the subject roofing framework can be used. In the preferred procedure, the main components of the subject roofing framework including the frames A and B are preassembled using jigs if necessary, and are shipped to the building site with the preassembled walls in a relatively compact form. In the case of a building such as that shown in FIG. 1, the four walls of the building including the wall with the door can be preassembled at a factory for easy installation and connection at the building site. Before installing and connecting the walls, however, it may be necessary to prepare a slab ahead of time to which the walls are attached. After the walls are assembled and attached to the slab or other floor structure, the building is ready to receive the subject roofing framework. If the end frames A and B have been preassembled at the factory, they are positioned on the tops of the respective opposite walls 12 of the building and made fast by such means as nails 90 (FIG. 3) driven through the rails 26 and 40 and into upper rails 92 or other upper portions of the walls 12 as are provided. Also, the frames A and B can be attached by drilling holes through the rails 26, 40 and 92 and using bolts and nuts to secure the connection. The holes used for this purpose can be predrilled at the factory, or they can be drilled at the building site with little effort. With end frames A and B in position and attached as described, the purlin beams 20 and 24 and the ridge beam 22 can be set in place in the notches 54, 68 and 70 of the end frame A and the corresponding notches provided in the end frame B, and the purlin beams can be made fast by nailing them to the column members or by using other fastening means, as preferred. It is also contemplated to have the purlin beams and the ridge beams extend beyond one or both opposite ends of the building to provide an overhang of the roof structure. Once the roof frame members A and B are installed as described and connected by the cross members or purlin beams, it is a simple matter to install the roof deck 18 theron. The members which form the roof deck 18 may include panels such as plywood panels 94, 96, 98 and 100 which are laid on the roof structure in the manner shown in FIG. 3. In the constructions shown there are provisions for four plywood panels which may be precut at the factory and, if necessary, beveled on their edges to make a more tight construction and to facilitate and speed up the construction and assembly at the building site. After each panel 94, 96, 98 and 100 is properly located on the framework, it is attached thereto using nails or other fasteners as desired. The final step in the assembly is to attach a protective roof covering over the plywood or like panels when such are used. This may involve applying a layer of tar paper to the plywood panels and attaching shingles thereon in the usual way. However, if the construction is made out of materials other than wood, such as out of steel or plastic, it may not be necessary to use any protective covering on the panels, and the panels may be painted or otherwise protected from the elements.

It should be apparent from what has been said that the subject roof framework which is at the heart of the invention is relatively easily fabricated especially under factory and assembly line conditions, using mass production techniques if desired, and it is also apparent that the entire building as well as the roof framework therefor can be prefabricated and packaged in a relatively compact, flat condition for ease in handling, storage and shipment. This includes not only the roof frame members but the building wall members as well. This makes the present construction particularly adaptable for sale to the do-it-yourself market where even a relatively unskilled person desiring an out-building for some purpose can buy a complete packaged house unit which he can install relatively easily using simple hand tools and component parts which one or two persons can easily handle. Also because of the way the present construction is put together, it will have considerable strength and durability and can be made to have a pleasing appearance and be used for many different purposes.

Figure 4:
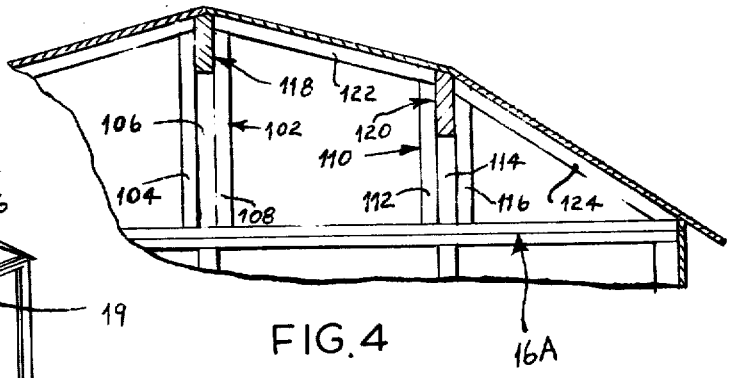

FIG. 4 shows an alternate embodiment 16A of the subject roof framework construction which is similar to the frame construction shown in FIGS. 1–3. As in the frame construction 16, the modified embodiment 16A has central vertical column members such as column member 102 which are formed by adjacent post members or boards such as boards 104, 106 and 108. The frame 16A also has other spaced vertical columns such as column 110 shown formed by boards 112, 114 and 116. Each of the columns in the construction is also made to have a downwardly extending slot or groove formed in its upper end for receiving and supporting one end of a purlin member such as the members 118 and 120 shown in FIG. 4. In the modified construction of FIG. 4, however, instead of extending between adjacent column members on each base member, the bracing members such as bracing member 122 have their end portions resting on the upper ends of boards forming the column members such as the boards 108 and 112. Also, the form 16A has other bracing members such as brace 124 which have one end portion resting on the upper end of a board member such as the board 116 and an opposite end portion in abutment with a respectively adjacent base member. This type construction may provide somewhat greater support for the roof deck positioned thereon. The modified construction has most of the same advantages as the structure described above and also lends itself to mass production under factory conditions. The differences between the constructions shown in FIGS. 3 and 4 are mostly matters of preferance and do not effect the basic concept of the present invention which is to provide a novel roof framework construction.

For purposes of this disclosure, the present invention has been illustrated being used in a hip-type roof framework primarily for use on relatively small out-buildings such as those used for storage and other purposes. Obviously, however, the subject roof framework can also be used on many different building constructions and can have many different sizes and shapes in addition to the hip-type shape shown in the drawing. For example, the subject construction can be made to have more than one hip on each side of the roof, it can have a hip side and a non-hip or flat side, if desired, and it can be constructed in many other shapes as well. It can also be modified to provide overhangs on one or both ends as well as on the sides, and it can be constructed and used on buildings of different lengths and widths.

Thus there has been shown and described a novel roof framework construction which fulfills all of the objects and advantages sought therefor. It will be apparent to those skilled in the art, however, that many changes, modifications, variations and other uses and applications for the subject framework are possible and contemplated; and, all such changes, modifications, variations and other uses and applications which do not depart from the spirit and scope of the invention are deemed to be covered by the invention which is limited only by the claims which follow.

What is claimed is:

1. A prefabricated building construction formed substantially by preassembled components comprising two pairs of preassembled building wall structures, and a pair of preassembled roof frame structures for attaching to the tops of a selected pair of said wall structures to support a roof deck thereabove, said frame structures each including a rail member for attaching the frames to respective ones of said selected pair of wall structures, said rail members each having a plurality of substantially vertical column members attached at corresponding and spaced apart locations therealong forming pairs of correspondingly located column members along said frame structures, each of said column members having an upper end portion including a central portion having a downwardly extending transverse groove formed therein, bracing members attached connecting selected ones of said column members on each of said frame structures; and a purlin beam member extending respectively between each of the pairs of correspondingly located column members on the frame structures, said purlin beam members having portions adapted to extend into and be attached within the grooves of respective pairs of the correspondingly located column members along said frame structures, said roof frame structures, said purlin beams and said bracing members providing a support structure on which the roof deck can be attached and supported.

2. A roof frame construction adapted to be mounted on a building structure having pairs of spaced opposite side walls comprising a pair of base members for attaching to the upper surfaces of a selected pair of opposed side walls of the building structure, each of said base members having a top surface and spaced opposite ends, a plurality of vertical column members mounted extending upwardly from the top surface of each of said base members at similar spaced locations therealong to form pairs of opposed column members located on opposite sides of the building structure, each of said column members having an upper end portion including a central portion with a transverse downwardly extending slot formed therein, a purlin member positioned extending between each opposed pair of column members on opposite sides of the building structure, said purlin members extending through the slots formed in the upper end portions of the respective column members, a brace member extending between and connecting the upper end portions of adjacent column members on each of the respective base members, and other brace members connecting the upper end portions of at least one of the column members on each of said base members and the upper surface of the respective base member adjacent to one of the ends thereof, each of said base members and the members associated therewith including the attached column members and the brace members forming an end frame roof structure capable of preassembly independently of the building side walls.

3. A roof frame construction for a building structure which is adapted to be prefabricated under factory conditions in a relatively small number of pre-assembled pieces and shipped to a building site for assembly as parts of a kit for assembling the entire building structure, said roof comprising a pair of pre-assembled end frame members each having a base member for mounting on the top of one of an opposed pair of side walls of the building, said base members each having a top surface, a plurality of upright column members mounted on the top surface of each of said base members at corresponding locations therealong, each of said column members being formed by at least three adjacent post members including a central post member which is shorter than the post members on opposite sides thereof so as to form a transverse downwardly extending groove in the upper end portion of each of the column members, each of said end frame members also having other means including brace members connected between the upper ends of selected ones of the column members, and roof support members extending respectively between the correspondingly located column members on each of the frame members, said roof support members having portions that extend into and through the grooves in the respective column members between which they extend and being supported thereby.

4. A roof frame construction for mounting on the walls of a building or the like comprising a pair of end frame roof structures each including a base member for attaching the respective frames in spaced and opposed relationship to each other atop a pair of opposed side walls of the building, each of said base members having a top surface thereon, and each of said pair of end frame structures including a plurality of upright column members attached to and extending upwardly from the top surfaces of the respective base members at corresponding locations forming pairs of opposed column members along the end frame structures, each of said column members having an upper end portion with a downwardly extending transverse slot formed therein at an intermediate location thereon, a roof support member extending respectively between each corresponding pair of opposed column members on said opposed frame structures, said roof support members having portions that extend into and through the slots in the upper ends of the respective pairs of opposed column members and being supported thereby, and said end frame roof structures having means including brace members connected between the upper ends of selected ones of adjacent ones of the column members on each of said opposed frame structures, said brace members, said roof support members, and said column members defining a grid structure to which a roof deck can be applied and attached.

5. The roof frame construction defined in claim 1 wherein the opposed end frame structures are formed of wood.

6. The roof frame construction defined in claim 1 wherein said roof frame end structures are formed of steel.

7. The roof frame construction defined in claim 1 wherein each of said roof frame structures includes at least three spaced column members, each of said column members being formed by at least three adjacent boards mounted extending upwardly from the respective base members, the central board of each column member being shorter than the boards on opposite sides thereof.

8. The roof frame construction defined in claim 1 wherein each of said opposed end frame roof structures includes three upwardly extending column members attached at spaced locations along the respective base members, the three column members of each of said roof frame structures including a central column member which extends upwardly from the base member a greater distance than the other column members.

9. The roof frame construction defined in claim 1 wherein said brace members are connected between the upper ends of each of the adjacent columns of each of the respective roof frame structures, and other brace members extending between the upper ends of selected ones of said column members and the upper surface of the associated base members.

10. The roof frame construction defined in claim 1 wherein the roof support members extend beyond the column members of at least one of said roof frame structures in a direction opposite from the other one of the pair of said roof frame structures to provide support for an overhang of a roof deck.

* * * * *

UNITED STATES PATENT AND TRADEMARK OFFICE

CERTIFICATE OF CORRECTION

PATENT NO. : 3,999,338
DATED : December 28, 1976
INVENTOR(S) : William L. Behan, Jr. and Thomas E. DeZern, Sr.

It is certified that error appears in the above-identified patent and that said Letters Patent are hereby corrected as shown below:

Column 6, line 32, "theron" should be "thereon".

Column 8, line 26, "opposite" should be "opposed".

Column 10, line 4, "1" should be "4"; line 7, "1" should be "4"; line 10, "1" should be "4"; line 18, "1" should be "4"; line 26, "1" should be "4"; line 33, "1" should be "4".

Signed and Sealed this

Eighth Day of March 1977

[SEAL]

*Attest:*

RUTH C. MASON
*Attesting Officer*

C. MARSHALL DANN
*Commissioner of Patents and Trademarks*